United States Patent [19]

Messina

[11] 4,000,678

[45] Jan. 4, 1977

[54] COVER FOR A MUSICAL INSTRUMENT

[76] Inventor: Richard A. Messina, 181 Barrows, Jamestown, N.Y. 14701

[22] Filed: Mar. 31, 1976

[21] Appl. No.: 672,403

Related U.S. Application Data

[63] Continuation-in-part of Ser. No. 515,587, Nov. 29, 1974.

[52] U.S. Cl. ..... 84/453; 150/52 R

[51] Int. Cl.[2] ..... G10G 7/00

[58] Field of Search ..... 84/1.16, 267, 327–329, 84/453; 150/52 R

[56] References Cited

UNITED STATES PATENTS

| | | | |
|---|---|---|---|
| 3,251,258 | 5/1966 | Parker | 84/453 |
| 3,309,954 | 3/1967 | Phillips et al. | 84/453 |
| 3,877,501 | 4/1975 | Toth | 84/453 X |

*Primary Examiner*—Lawrence R. Franklin

[57] ABSTRACT

A cover for a musical instrument such as an electrical guitar or the like made up of a front cover member and a back cover member forming a front and a back for the cover of the instrument is disclosed. The front cover member and the back cover member are sewn together along one side of the instrument, and a zipper attached to the front cover member and the back cover member form a closure for the side opposite the seam. A recess is formed between the zipper and the seam for a first strap knob and a second recess is formed in the cover for a second strap knob. A control knob cover is provided for three control knobs familiar to those acquainted with electrical guitars.

1 Claim, 6 Drawing Figures

COVER FOR A MUSICAL INSTRUMENT

REFERENCE TO PRIOR APPLICATIONS

The application is a continuation-in-part of Ser. No. 515,587, filed Nov. 29, 1974.

OBJECTS OF THE INVENTION

An object of the invention is to provide an improved instrument cover.

Another object of the invention is to provide an improved cover for an electrical guitar or the like.

Another object of the invention is to provide an instrument cover that is simple in construction, economical to manufacture, and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions, and minor details of construction without departing from the spirit or sacrificing any of the advantages of the invention.

GENERAL DESCRIPTION OF DRAWINGS

DETAILED DESCRIPTION OF DRAWINGS

Figure 1:
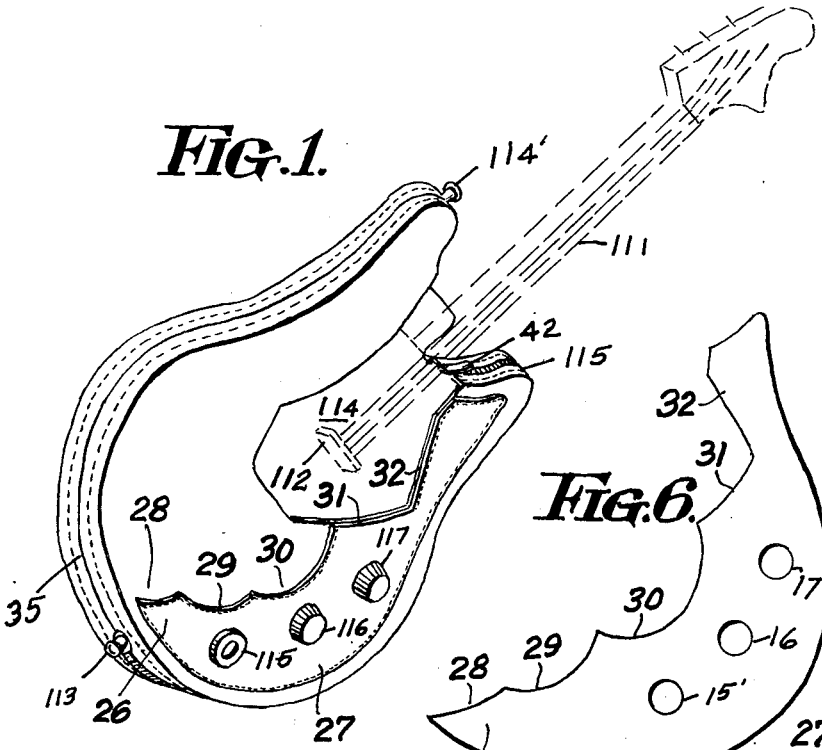
FIG. 1 is an isometric view of the cover according to the invention in place on an instrument.
Figure 6:
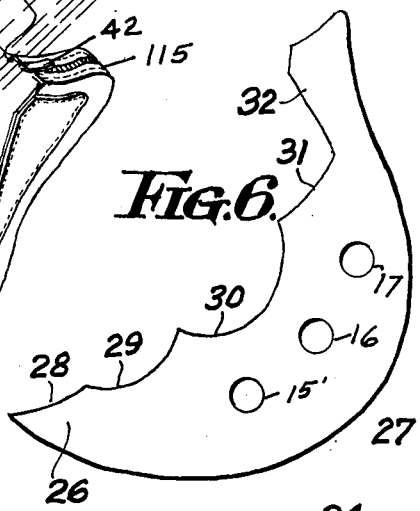
FIG. 6 is a view of the control knob cover.

Now, with more particular reference to the drawings, the cover for a musical instrument has a front cover sheet 10 and a back cover sheet 11. Both the front cover sheet and the back cover sheet may be made of vinyl, leatherette or other suitable flexible material. The instrument for which the cover is made has a sound box 110 which has a neck 111 indicated in phantom lines and attached to one end of sound box 110. The instrument has a bridge 112 of a type familiar to those skilled in the art. A first strap button 113 is provided on the end of the sound box opposite the neck 111 for receiving a strap and the second button 114 is supported on the corner of the sound box adjacent the neck. The sound box has a second corner 115 on the side of the neck opposite the button 114.

The front cover sheet 10 and back cover sheet 11 each has a portion spaced inward from the fold line 13 and the fold line 21 that are approximately coextensive with the corners defining the contour of the soundbox.

The front cover sheet and the back cover sheet may be folded back on themselves along the line 20 and the rear cover may be folded back on itself along the line 22'. The line 20 is spaced from the line 13 a distance equal to approximately half the thickness of the soundbox. The line 22' is spaced from the line 21 the thickness approximately equal to half the thickness of the soundbox.

The top cover sheet may be recessed at 33 to receive the bridge 112 and the cover sheet will be recessed at 18 and 19 and the back cover sheet will be recessed at 23 and 24 to receive the button 113 and 114 respectively.

The front cover sheet 10 may be sewn to the back cover sheet 11 along the fold line 22 by means of a suitable sewing thread and the flap between the recess 19 and the recess 33 indicated at 34 may be sewn together. A zipper 22 having an upper tape 35 and a lower tape 36 may have their tapes sewn to the front sheet and the back sheet 11 respectively.

To install the cover on the instrument, the zipper will be opened from the end 37 adjacent the corner 115 to the recess 23.

The control knob openings 15, 16 and 17 are formed in the front sheet to receive the control knobs 115, 116, and 117 on the instrument. The control knob cover 26 has holes 15', 16' and 17' that overlie the holes 15, 16 and 17 in the front sheet 10. First strap button 114 is inserted in its recess 19 and 24, and the sound box is nestled against the seam sewn along lines 36 and 20 between recesses 18 and 23 and recess 19 and 24.

Figure 4:
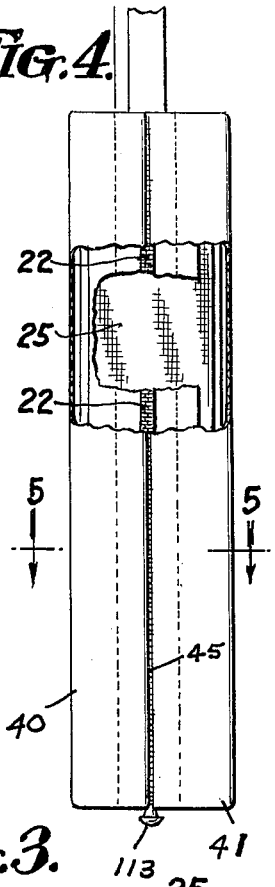
FIG. 4 is a side view of the cover in place on an instrument.
Figure 2:
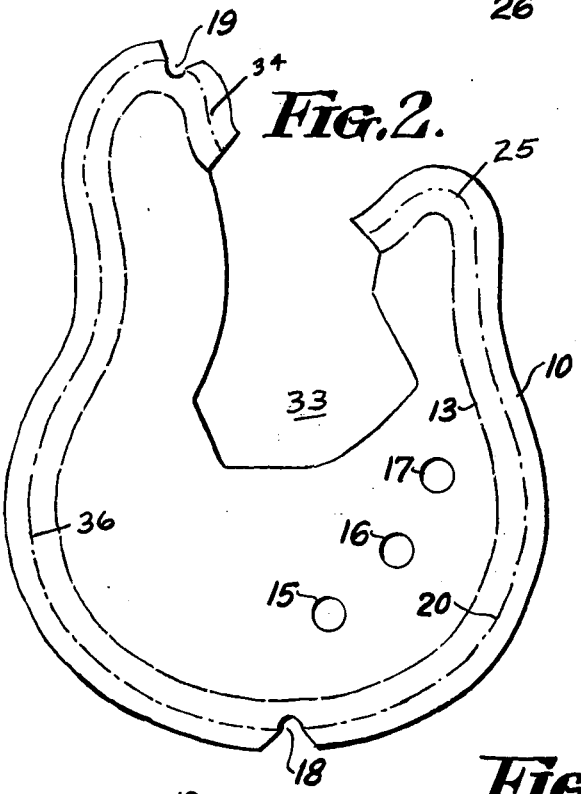
FIG. 2 is a view of the front cover before it is assembled to the back cover.
Figure 3:
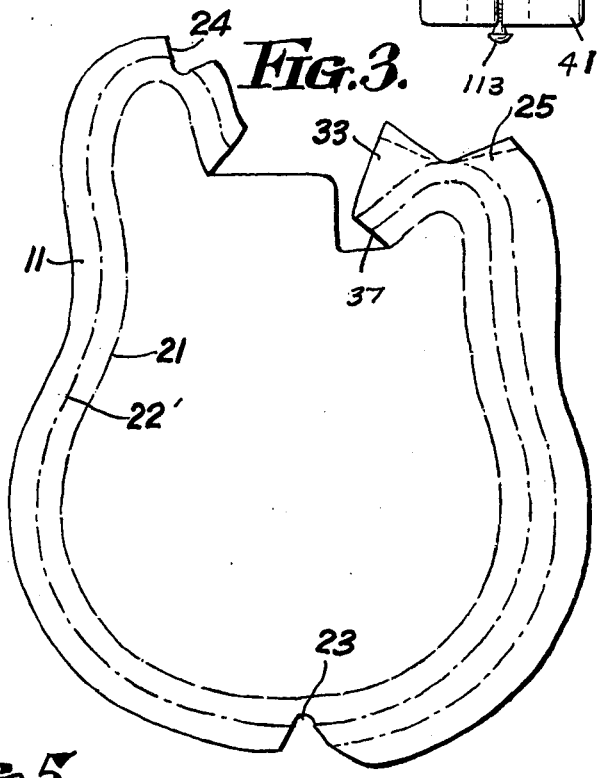
FIG. 3 is a view of the back cover.
Figure 5:
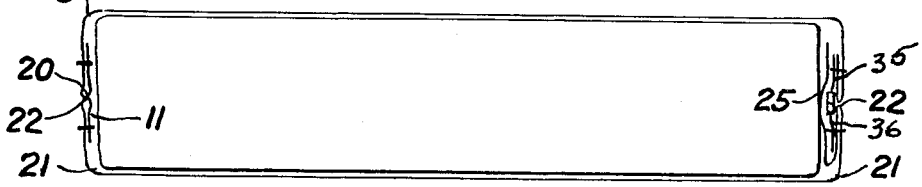
FIG. 5 is a cross section view taken on line 5—5 of FIG. 4.

The zipper 22 is first released in a usual manner and the sides 40 and 41 are swung apart from each other. The instrument is then inserted and the button 114 is inserted through the opening formed by the recesses 19 and 24 and the instrument swings into the case. The zipper can then be engaged by moving the slider 42 to the position shown in FIG. 1. The flap 25 will swing inwardly and overlie the instrument sound box as shown in FIG. 4 to protect it from the zipper part 45.

The foregoing specification sets forth the invention in its preferred practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A cover for a musical instrument having a sound box, a neck attached to one side of said sound box and extending therefrom and a bridge supported on another side of said soundbox, a first means on said sound box for attaching a strap on the end thereof remote from said neck, and a second means for attaching a strap on a corner adjacent said neck remote from said first mentioned means, said sound box having a second corner on the end thereof adjacent said neck at the side thereof remote from said first mentioned corner, a plurality of control buttons on one side of said sound box spaced from said bridge, said cover comprising a front sheet and a back sheet, each having a fold line generally in the shape of the edges of said sound box of said instrument, a marginal edge extending outward from said fold line, and adapted to be folded back at said fold line and to be stitched in place, said back sheet having a wider flap on one side thereof than said front sheet whereby when said rear sheet is folded back and sewn said flap can swing outwardly beyond said fold line, said front sheet and said back sheet each having a notch cut therein to receive said first mentioned means for attaching a strap and a second notch cut in said flaps to receive said second mentioned means to attach a strap, said front sheet being notched to receive said bridge and a plurality of openings in said front sheet for receiving said control buttons, a control cover attached to said front sheet, said control cover having openings registering with said holes in said front sheet and being generally crescent shaped and having a side cut out forming an edge to lie along the top of said front sheet, said crescent shaped side of said cover registering with the marginal edge of said cover.

* * * * *